US005230993A

United States Patent [19]

Yamada et al.

[11] Patent Number: 5,230,993

[45] Date of Patent: Jul. 27, 1993

[54] SILVER HALIDE PHOTOGRAPHIC ELEMENT

[75] Inventors: Sumito Yamada; Ichizo Toya; Tomokazu Yasuda; Shigeru Ohno, all of Kanagawa, Japan

[73] Assignee: Fuji Photo Film Co., Ltd., Kanagawa, Japan

[21] Appl. No.: 513,005

[22] Filed: Apr. 24, 1990

Related U.S. Application Data

[63] Continuation of Ser. No. 202,863, Jun. 6, 1988, abandoned.

[30] Foreign Application Priority Data

Jun. 5, 1987 [JP] Japan ..... 62-141111

[51] Int. Cl.[5] ..... G03L 1/06

[52] U.S. Cl. ..... 430/518; 430/523; 430/527

[58] Field of Search ..... 430/518, 523, 527

[56] References Cited

U.S. PATENT DOCUMENTS

| | | | |
|---|---|---|---|
| 3,143,421 | 8/1964 | Nadeau et al. | 96/87 |
| 3,624,229 | 11/1971 | Timmerman et al. | 430/518 |
| 3,625,694 | 12/1971 | Cohen et al. | 430/518 |
| 3,788,855 | 1/1974 | Cohen et al. | 430/518 |
| 3,898,088 | 8/1975 | Cohen et al. | 430/518 |
| 3,948,663 | 4/1976 | Shiba et al. | 430/518 |
| 3,958,995 | 5/1976 | Campbell et al. | 430/518 |
| 4,312,940 | 1/1982 | Nakamura et al. | 430/518 |
| 4,353,972 | 10/1982 | Helling et al. | 430/518 |
| 4,379,838 | 4/1983 | Helling et al. | 430/518 |
| 4,429,272 | 1/1984 | Taylor | 430/518 |
| 4,500,631 | 2/1985 | Sakamoto et al. | 430/518 |

OTHER PUBLICATIONS

D. A. Spencer, The Focal Dictionary of Photographic Technologies (Focal Press, London and New York) (1973) p. 604.

*Primary Examiner*—Jack P. Brammer

*Attorney, Agent, or Firm*—Sughrue, Mion, Zinn, Macpeak & Seas

[57] ABSTRACT

A photographic light-sensitive material for medical use or nondestructive testing use is described, comprising (1) a support having thereon at least one light-sensitive silver halide emulsion layer, and (2) a polymer located on the same side of the support as an emulsion layer and capable of providing a cation site in a fixing solution.

6 Claims, No Drawings

SILVER HALIDE PHOTOGRAPHIC ELEMENT

This is a continuation of application Ser. No. 07/202,863 filed Jun. 6, 1988, now abandoned.

FIELD OF THE INVENTION

The present invention relates to a silver halide photographic material (which will be referred as senditive material, hereinafter), and, more particularly, to radiographic sensitive materials for medical use (e.g., a medical direct X-ray film) and for nondestructive testing use (e.g., an industrial X-ray sensitive material).

BACKGROUND OF THE INVENTION

Hitherto, a considerable reduction in time for photographic processing of radiographic sensitive materials for medical use and X-ray sensitive materials for industrial use has been achieved by unceasing improvements in sensitive materials and processing agents. In particular, the reduction in processing time is very important for radiographic sensitive materials for medical use, because in an emergency a doctor should not lose any time, even 1 second, in making a diagnosis and giving a treatment. In the case of industrial X-ray sensitive materials, on the other hand, it is necessary to coat a large quantity of silver since the sensitivity of sensitive materials of this kind to X-rays largely depends on the silver coverage thereof, and consequently a much longer processing time is required of the industrial X-ray sensitive materials in contrast to radiographic sensitive materials for medical use. For the present, a rapid processing with an automatic developing machine is popular, and the Dry to Dry total photographic processing time ranges from 90 sec. to 3.5 min. for radiographic sensitive materials for medical use, while it ranges from 5 min. to 11 min. for industrial X-ray sensitive materials. Under these circumstances, a further reduction in such a Dry to Dry processing time is desired.

In order to reduce the photographic processing time, the processing time in each step, including development, fixing, washing and drying should be shortened. A reduction in development time is generally known to be achieved by enhancing the activity of the developer through increasing the concentration of the developing agent, pH, development temperature or so on, or by increasing the development promotability of a silver halide emulsion itself. However, enhancement of the activity of a developer is not necessarily bound up with enhancement of the value as a commodity since it brings the cost up and/or spoils the keeping stability of the developer itself. On the other hand, washing and drying times largely depend upon the thickness and the swelling degree of the coated layers that constitute a sensitive material. Therefore, it is possible to reduce such processing times by previously using a hardener in a sufficient quantity to heighten the cross-linking degree of gelatin. However, the heightening of the cross-linking degree of gelatin causes a drop in covering power which necessitates an increase in silver coverage, and is also bound up with lowering of sensitivity and development promotability, and further a decrease in fixing speed. As described above although there are methods for reducing the processing time in each step, such methods are attended by ill effects, and it is difficult to ensure a reduction beyond the present situation in regard to the Dry to Dry processing time.

SUMMARY OF THE INVENTION

An object of the present invention is to provide a radiographic sensitive material for medical use and an industrial X-ray sensitive material which are greatly reduced in fix-processing time without being attended by any deterioration in photographic characteristics achieved to date and which undergo an improvement in color contamination when they are designed as a color sensitized system.

The above-described object of the present invention is attained by providing a photographic light-sensitive material for medical use or non-destructive testing use comprising (1) a support having thereon at least one light-sensitive silver halide emulsion layer, and (2) a polymer located on the same side of the support as an emulsion layer and capable of providing a cation site in a fixing solution.

DETAILED DESCRIPTION OF THE INVENTION

The layer in which a polymer capable of providing a cation site in a fixing solution is incorporated may be an emulsion layer, a surface protective layer, or a subbing layer which is located on the same side of the support as an emulsion layer.

As the polymer capable of providing a cation site in a fixing solution, anion conversion polymers are preferred.

Examples of anion conversion polymers which can be used in the present invention include various kinds of known quaternary ammonium (or phosphonium) salts of polymers. Such quaternary ammonium (or phosphonium) salts of polymers are widely known as mordant polymers and polymeric antistatic agents, e.g., in publications as cited below, and so on.

Specifically, water dispersed latexes described in Japanese Patent Application (OPI) No. 166940/84 (the term "OPI" as used herein means an "unexamined published Japanese patent application"), U.S. Pat. No. 3,958,995, and Japanese Patent Application (OPI) Nos. 142339/80, 126027/79, 155835/79, 30328/78 and 92274/79; polyvinyl pyridinium salts described in U.S. Pat. Nos. 2,548,564, 3,148,061 and 3,756,814; water-soluble quaternary ammonium salts of polymers described in U.S. Pat. No. 3,709,690; and no water-soluble type quaternary ammonium salts of polymers described in U.S. Pat. No. 3,890,088 can be mentioned.

Preferred anion conversion polymers are represented by formula (I):

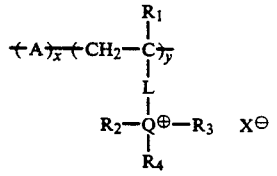

(I)

In the above formula, A represents one or more ethylenically unsaturated monomer units. $R_1$ represents a hydrogen atom or a lower alkyl group having 1 to about 6 carbon atoms. L represents a divalent group having 1 to about 12 carbon atoms. $R_2$, $R_3$ and $R_4$ may be the same or different, and each represents an alkyl group having 1 to about 20 carbon atoms, an aralkyl group having 7 to about 20 carbon atoms, or a hydrogen atom. Also, they may combine with one another to form a cyclic structure together with Q. It is desired in respect of color of stains that only one among $R_2$, $R_3$ and $R_4$ is a hydrogen atom. Q is N or P. $X\ominus$ represents an anion other than an iodine ion. x is 0 to about 90 mol %, and y is about 10 to about 100 mol %.

Specific examples of ethylenically unsaturated monomers for A include olefins (such as ethylene, propylene, 1-butene, vinyl chloride, vinylidene chloride, isobutene, vinyl bromide, etc.), dienes (such as butadiene, isoprene, chloroprene, etc.), ethylenically unsaturated esters of aliphatic or aromatic carboxylic acids (such as vinyl acetate, allyl acetate, vinyl propionate, vinyl butyrate, vinyl benzoate, etc.), esters of ethylenically unsaturated acids (such as methylmethacrylate, butylmethacrylate, tertbutylmethacrylate, cyclohexylmethacrylate, benzylmethacrylate, phenylmethacrylate, octylmethacrylate, amylacrylate, 2-ethylhexylacrylate, benzylacrylate, dibutyl maleate, diethyl fumarate, ethyl crotonate, dibutyl methylenmalonate, etc.), styrenes (such as styrene, α-methylstyrene, vinyltoluene, chloromethylstyrene, chlorostyrene, dichlorostyrene, bromostyrene, etc.), and unsaturated nitriles (e.g., acrylonitrile, methacrylonitrile, allyl cyanate, crotononitrile, etc.). Of these monomers, styrenes and methacrylates are preferred over others with respect to the facility in emulsion polymerization and hydrophobicity. A may be composed of two or more of the above-cited monomers.

As for $R_1$, a hydrogen atom or methyl group is preferred with respect to reactivity in polymerization.

As for L, the divalent groups represented by

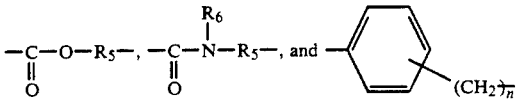

are preferred. Among these groups,

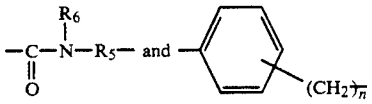

are preferred with respect to alkali resistance. In particular,

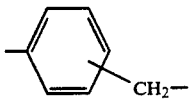

is desirable from the standpoint of facility in emulsion polymerization.

In the above formulae, $R_5$ represents an alkylene group (e.g., methylene,ethylene,trimethylene, tetramethylene, etc.), or an arylene or aralkylene group (e.g.,

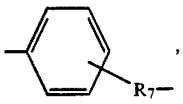

wherein $R_7$ is an alkylene group having 0 to about 6 carbon atoms), and $R_6$ represents a hydrogen atom or $R_2$. n is an integer of 1 or 2.

Q is preferably N with respect to harmlessness of starting materials to be used, and so on.

$X\ominus$ is an anion other than an iodine ion. Specific examples of the anion include halogen ions (such as a chlorine ion, bromine ion, etc.), alkylsulfuric acid ions (such as a methylsulfuric acid ion, ethylsulfuric acid ion, etc.), alkyl- or aryl-sulfonic acid ions (such as a methanesulfonic acid ion, ethanesulfonic acid ion, a benzenesulfonic acid ion, p-toluenesulfonic acid ion, etc.), a nitric acid ion, an acetic acid ion, a sulfonic acid ion, and so on. Among these anions, chlorine, alkylsulfonic acid, arylsulfonic acid and sulfuric acid ions are particularly preferred over others.

Alkyl and aralkyl groups represented by $R_2$, $R_3$ and $R_4$ include substituted ones also.

As examples of the unsubstituted alkyl groups for $R_2$, $R_3$ and $R_4$, methyl, ethyl, propyl, isopropyl, t-butyl, hexyl, cyclohexyl, 2-ethylhexyl, dodecyl and the like may be mentioned. As examples of the substituted alkyl groups for $R_2$, $R_3$ and $R_4$, alkoxyalkyl groups (such as methoxymethyl, methoxybutyl, ethoxyethyl, butyoxyethyl, vinyloxyethyl, etc.), cyanoalkyl groups (such as 2-cyanoethyl, 3-cyanopropyl, etc.), halogenated alkyl groups (such as 2-fluoroethyl, 2-chloroethyl, perfluoropropyl, etc.), alkoxycarbonylalkyl groups (such as ethoxycarbonylmethyl, etc.), allyl, 2-butenyl, propargyl and the like may be mentioned.

As examples of aralkyl groups for $R_2$, $R_3$ and $R_4$, mention may be made of unsubstituted aralkyl groups such as benzyl, phenethyl, diphenylmethyl, naphthylmethyl, etc., and substituted ones including alkylaralkyl groups (such as 4-methylbenzyl, 2,5 -dimethylbenzyl, 4-isopropylbenzyl, 4-octylbenzyl, etc.), alkoxyaralkyl groups (such as 4-methoxybenzyl, 4-pentafluoropropenyloxybenzyl, 4-ethoxybenzyl, etc.), cyanoaralkyl groups (such as 4-cyanobenzyl, 4-(4-cyanophenyl)benzyl, etc.), halogenated aralkyl groups (such as 4-chlorobenzyl, 3-chlorobenzyl, 4-bromobenzyl, 4-(4- chlorophenyl)benzyl, etc.), and so on.

The number of carbon atoms contained in such alkyl groups is preferably from 1 to 12, and the number of carbon atoms contained in such aralkyl groups is preferably 7 to 14.

As examples of cyclic structures formed by properly combining Q, $R_2$, $R_3$ and $R_4$, mention may be made of those represented by the following formula;

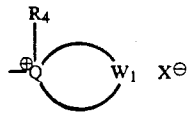

(wherein $W_1$ represents atoms necessary to complete an aliphatic heterocyclic ring together with Q).

Specific examples of such aliphatic heterocyclic rings include those of the following formulae.

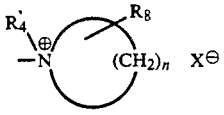

(wherein $R_8$ represents a hydrogen or 4; and n is an integer of 2 to 12),

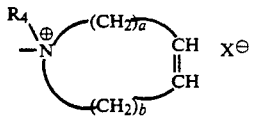

(wherein the sum of a and b is an integer of from 2 to 7).

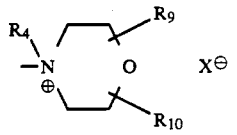

(wherein $R_9$ and $R_{10}$ each represents a hydrogen atom, or a lower alkyl group having 1 to 6 carbon atoms), and

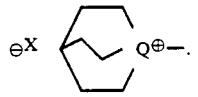

In addition to these heterocyclic rings, there can be cited

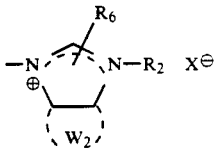

(wherein $W_2$ may be absent or may be atoms necessary to form a benzene ring),

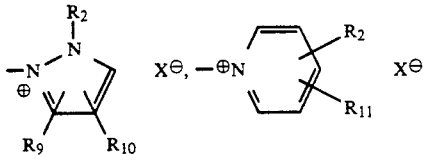

(wherein $R_{11}$ represents a hydrogen atom, $—COOR_2$, $—CONR_2R_6$, or $R_2$, and when two $R_2$'s are present they may be the same or different), and so on.

Of these cyclic structures,

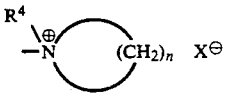

(n=an integer of 4 to 6) and

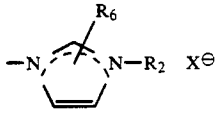

are preferred over others.

In the above examples, $R_2$, $R_4$, $R_6$, Q and have the same meanings as defined for the formula (I).

The y component may be composed of two or more monomers.

x is preferably 10 to 50 mol % and particularly preferably 20 to 50 mol %, while y is preferably 50 to 90 mol % and particularly preferably 50 to 80 mol %.

In order to prevent the polymer of the present invention from moving from the prescribed layer into other layers or a processing solution to exert photographically undesirable effects, it is particularly preferred to use the polymer of the present invention in the form of cross-linked aqueous polymer latex, which is obtained by copolymerizing with a monomer containing at least two (preferably from 2 to 4) ethylenically unsaturated groups.

It is preferred that the cross-linked aqueous polymer latex should have a structure represented by formula (II):

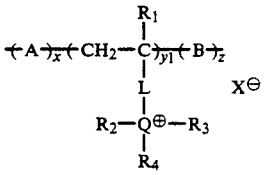

(II)

In the above formula, A, $R_1$, $R_2$,$R_3$, $R_4$, L, Q, $X^{\ominus}$ and x have the same meanings as in the formula (I), respectively. $y_1$ ranges from 10 to 99.9 mol %, preferably from 10 to 95 mol %.

z ranges from 0.1 to 50 mol %, preferably from 1 to 30 mol %.

B represents a constitutional repeating unit of a copolymer, which is derived from a copolymerizable monomer containing at least two ethylenically unsaturated groups. Specific examples of monomers from which B is derived include ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allylmethacrylate, allylacrylate, diallyl phthalate, methylenebisacrylamide, methylenebismethacrylamide, trivinylcyclohexane, divinylbenzene, N,N-bis(-vinylbenzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-p-xylylenediammonium dichloride, N,N'-bis(-vinylbenzyl)-triethylenediammonium dichloride, N,N,N',N'-tetrabutyl-N,N'-bis(vinylbenzyl)-ethylenediammonium dichloride, and so on. Among these copolymerizable monomers, divinylbenzene and trivinylcyclohexane are particularly preferred over others with respect to hydrophobicity, alkali resistance and so on.

Specific examples of the polymers capable of providing a cation site in a fixing solution are set forth below, but the invention is not to be construed as being limited to the specific examples.

EXAMPLE OF COMPOUND

-continued

I)

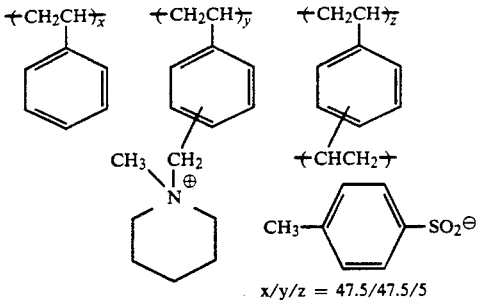

x/y/z = 47.5/47.5/5

II)

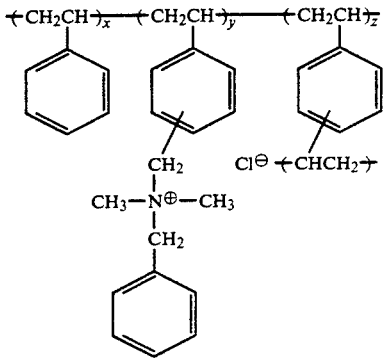

x/y/z = 45/45/10

III)

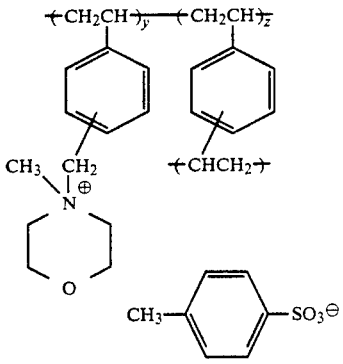

y/z = 95/5

-continued

IV)

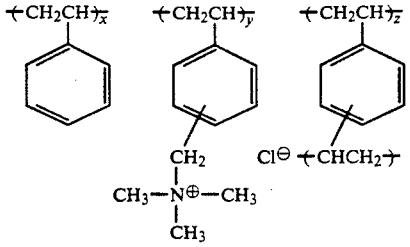

x/y/z = 45/45/10

V)

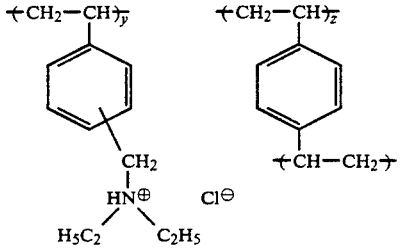

y/z = 80/20

VI)

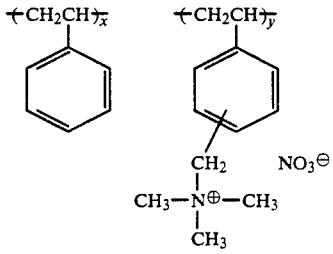

x/y = 50/50

VII)

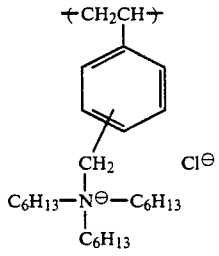

In addition, polymers containing residues produced by the reaction of ketones with aminoguanidine derivatives, as described in Japanese Patent Application (OPI) No. 13935/72, Japanese Patent Publication No. 15820/74, U.S. Pat. Nos. 2,882,156 and 3,740,228, can be employed. Specific examples of polymers of the above-described kind are illustrated below, but the invention should not be construed as being limited to the specific examples.

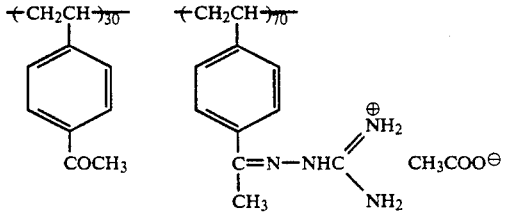

-continued

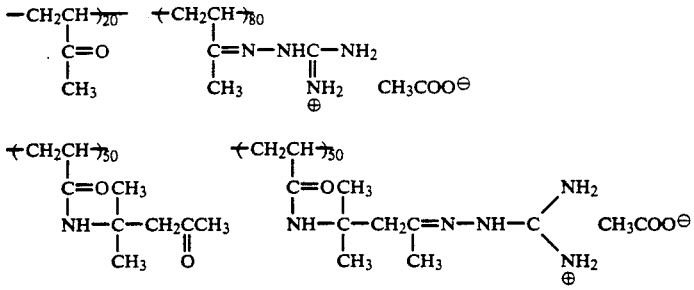

The polymer of the kind which can provide a cation site in a fixing solution is added in an amount of generally 0.1 or more, preferably 0.3 to 100, more preferably 0.5 to 30, expressed in terms of the number of cation sites, per 1 mole of the total amount of iodine in the sensitive material.

Although the polymer of the kind which can provide a cation site in a fixing solution can be incorporated into a light-sensitive layer or a light-insensitive layer, it is preferably incorporated into a light-insensitive layer provided between a light-sensitive layer and a support. When incorporated into a subbing layer, the polymer can produce a particularly desirable effect.

Of the polymers capable of providing a cation site, those having a high halogen ion-capturing ability are preferred over others.

The cation site-providing polymers of the present invention can also be employed as substances for mordanting anti-halation dyes and irradiation-preventing dyes. In this case, it is to be preferred that the dyes used should be anionic dyes capable of being decolored in the course of the development-fixing-washing procedure. In double-sided direct X-ray films for medical use, the combined incorporation of the cation site-providing polymer of the present invention and the above-mentioned kind of anionic dye to a subbing layer can produce an especially desirable effect, because it can cut crossover light by mordanting the decolorizable dye on the under side of emulsion layers to result in enhancement of sharpness.

Suitable examples of anionic dyes which can be utilized in the present invention include oxonol dyes having a pyrazolone nucleus or a barbituric acid nucleus, as described in British Patent Nos. 506,385, 1,177,429, 1,311,884, 1,338,799, 1,385,371, 1,467,214, 1,433,102 and 1,553,516, Japanese Patent Application (OPI) Nos. 85130/73, 114420/74, 117123/77, 161233/80 and 111640/84, Japanese Patent Publication Nos. 22069/64 and 13168/68, U.S. Pat. Nos. 3,247,127, 3,469,985 and 4,078,933, and so on; other oxonol dyes described in U.S. Pat. Nos. 2,533,472 and 3,379,533, British Patent No. 1,278,621, and so on; azo dyes described in British Patent Nos. 575,691, 680,631, 599,623, 786,907, 907,125 and 1,045,609, U.S. Pat. No. 4,255,326, Japanese Patent Application (OPI) No. 211043/84, and so on; azomethine dyes described in Japanese Patent Application (OPI) Nos. 100116/75 and 118247/79, British Patent Nos. 2,014,598 and 750,031, and so on; anthraquinone dyes described in U.S. Pat. No. 2,865,752; arylidene dyes described in U.S. Pat. Nos. 2,538,009, 2,688,541 and 2,538,008, British Patent Nos. 584,609 and 1,210,252, Japanese Patent Application (OPI) Nos. 40625/75, 3623/76, 10927/76 and 118247/79, Japanese Patent Publication Nos. 3286/73 and 37303/84, and so on; styryl dyes described in Japanese Patent Publication Nos. 3082/53, 16594/69 and 28898/82, and so on; triarylmethane dyes described in British Patens Nos. 446,583 and 1,335,442, Japanese Patent Application (OPI) No. 228250/84, and so on; merocyanine dyes described in British Patent Nos. 1,075,653, 1,153,341, 1,284,730, 1,475,228 and 1,542,807, and so on; and cyanine dyes described in U.S. Pat. Nos. 2,843,486 and 3,294,539, and so on.

Representatives of the above-cited dyes are illustrated below. However, the invention should not be construed as being limited to these representative dyes.

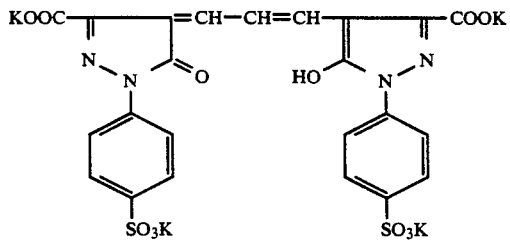

1.

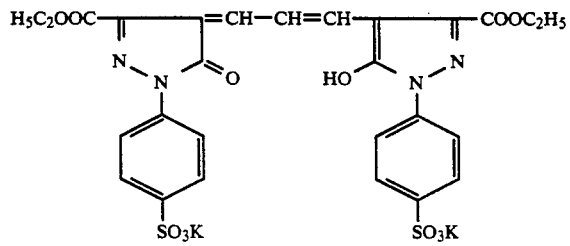

2.

-continued
3.
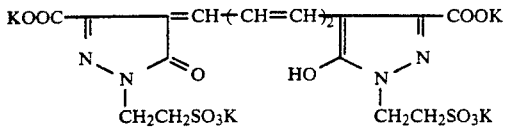
4.
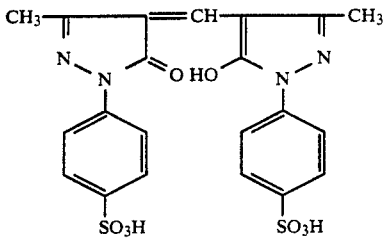
5.
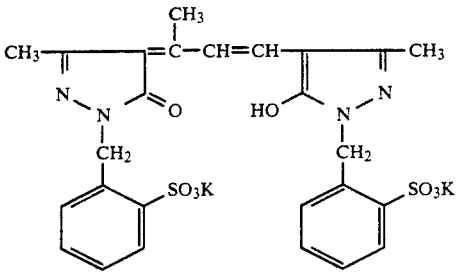
6.
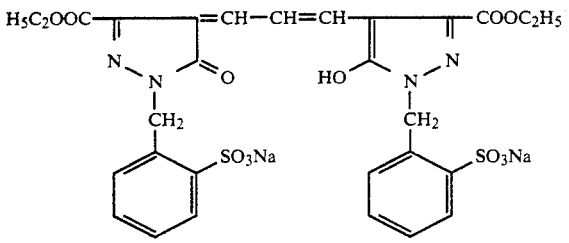
7.
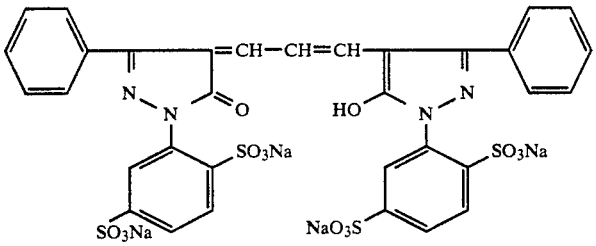
8.
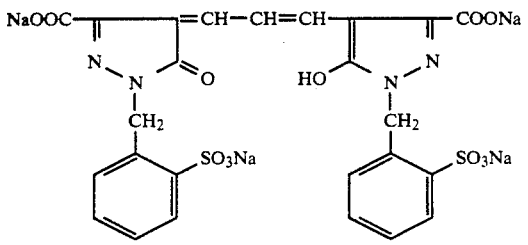

-continued
9.
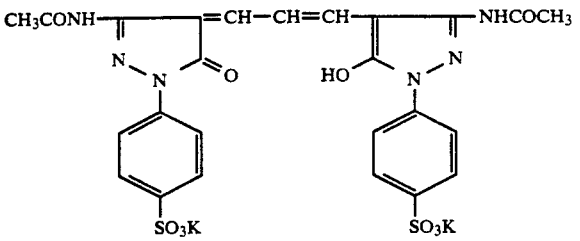
10.
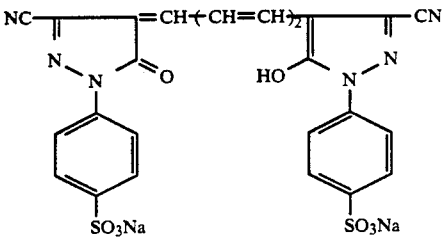
11.
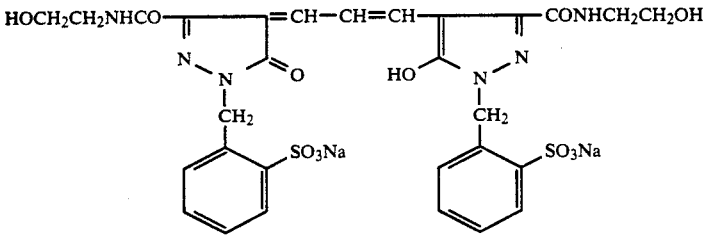
12.
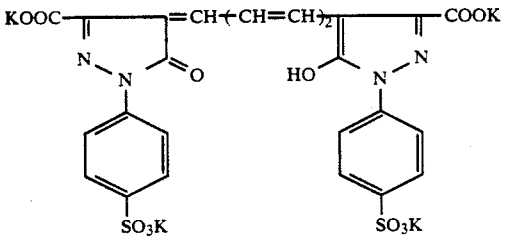
13.
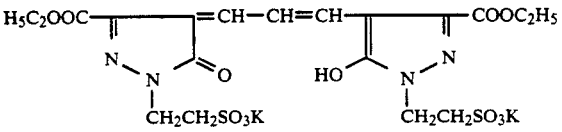
14.
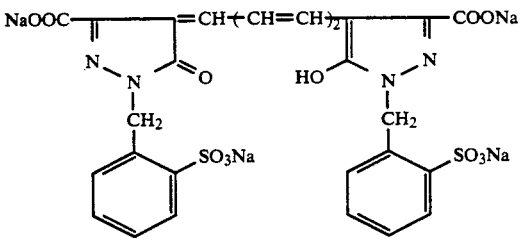
15.
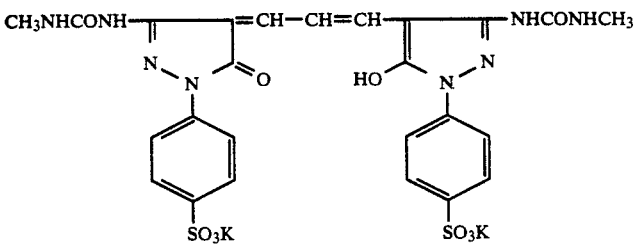

-continued
16.
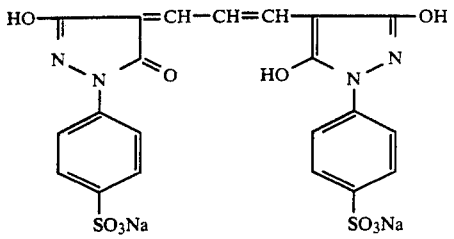
17.
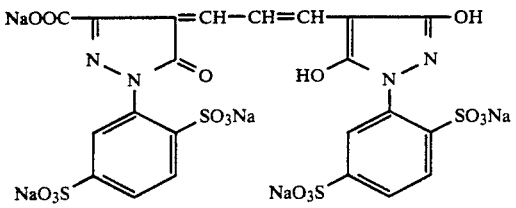
18.
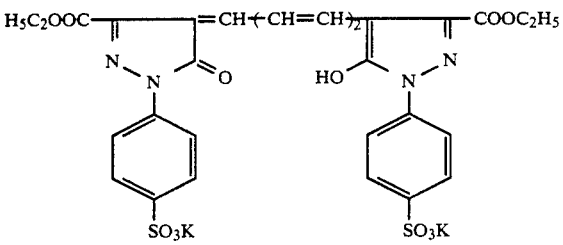
19.
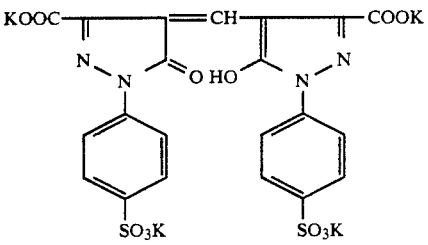
20.
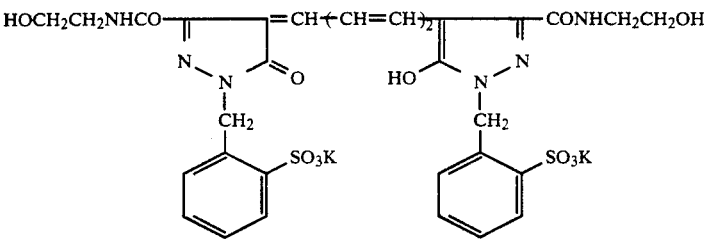
21.
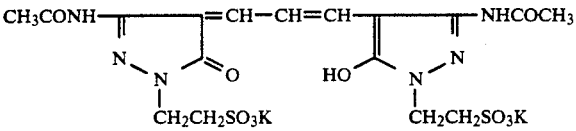
22.
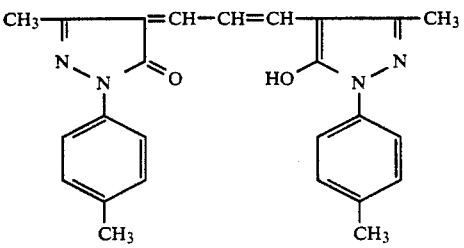

-continued
23.
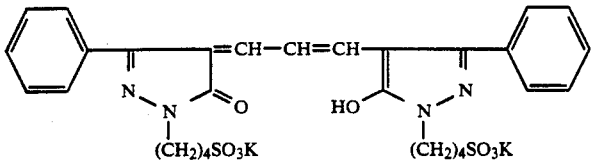
24.
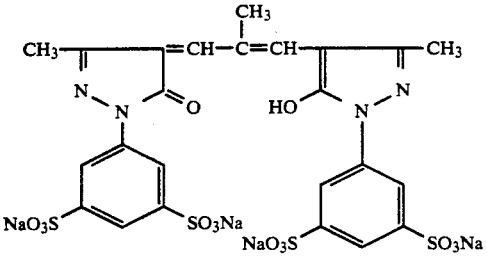
25.
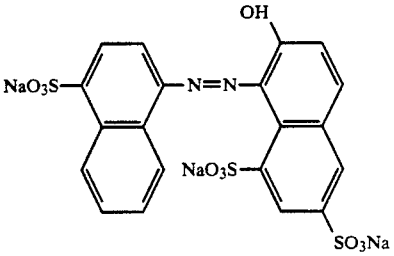
26.
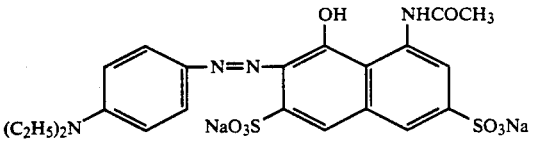
27.
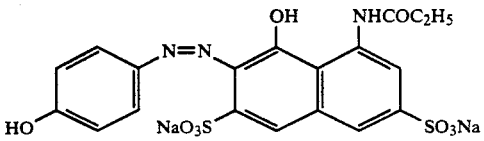
28.
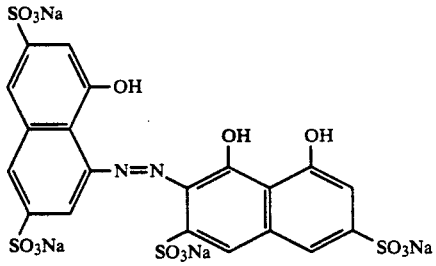
29.
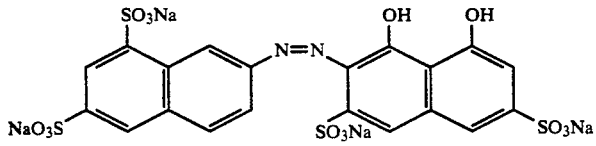

-continued
30.
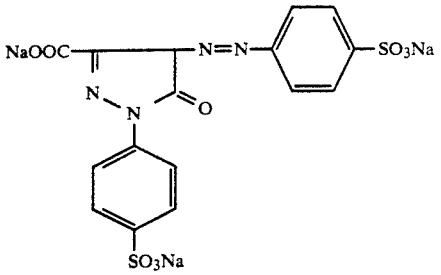
31.
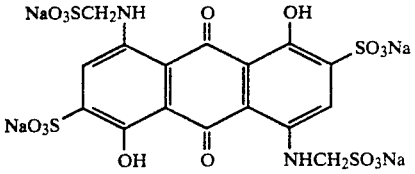
32.
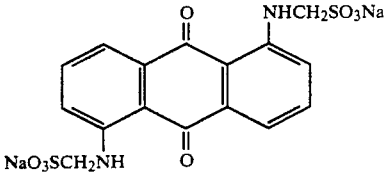
33.
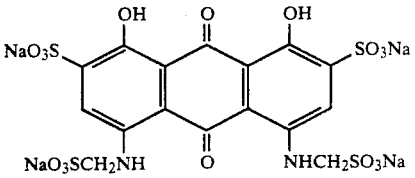
34.
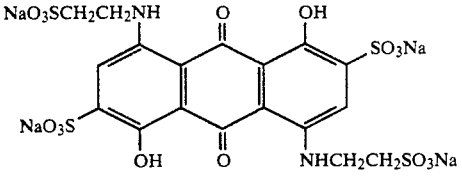
35.
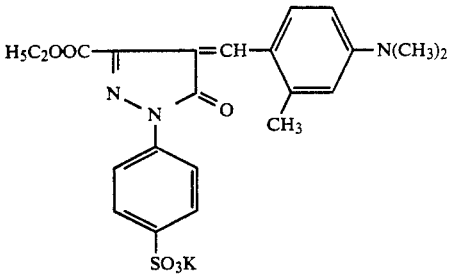
36.
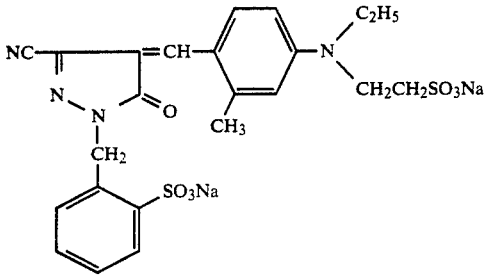

-continued
37.
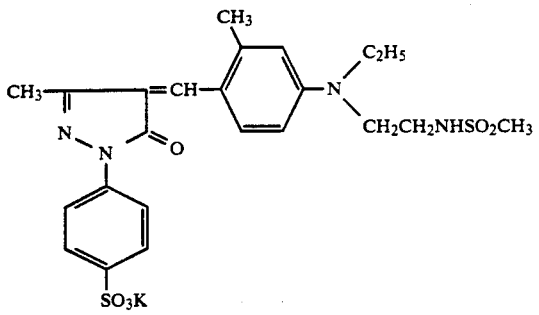
38.
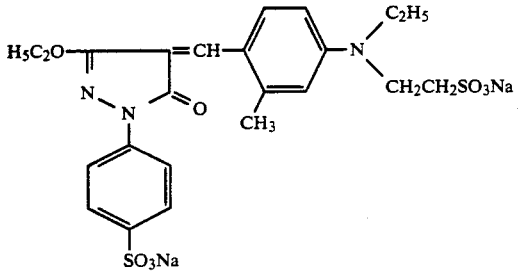
39.
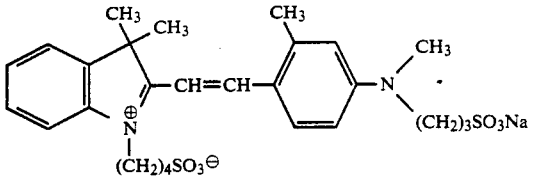
40.
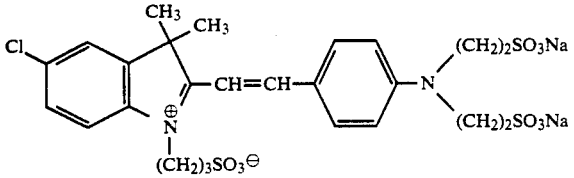
41.
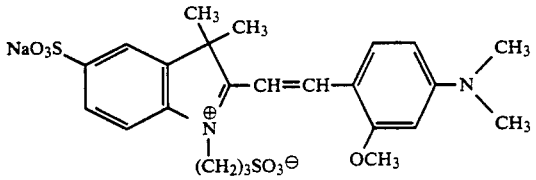
42.
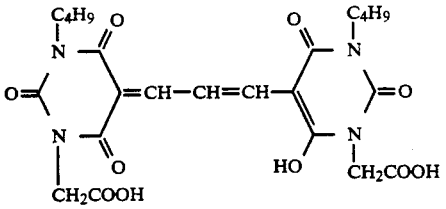
43.
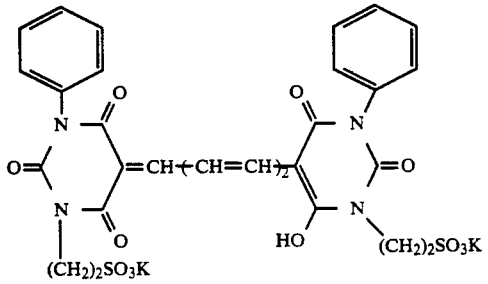

-continued
44.
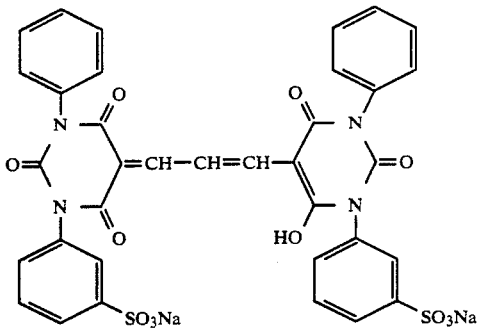
45.
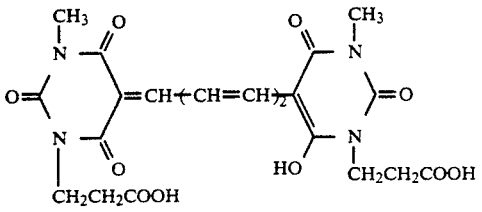
46.
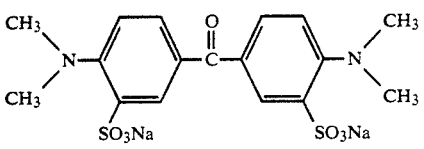
47.
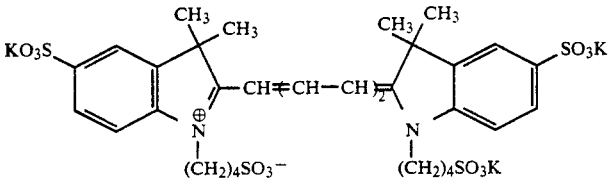
48.
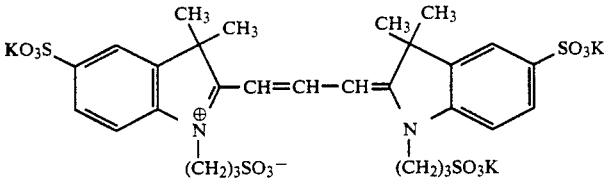
49.
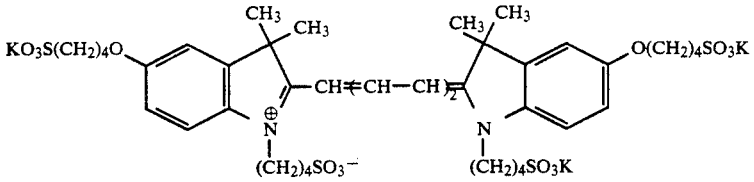
50.
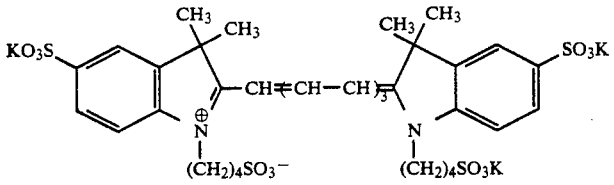
51.
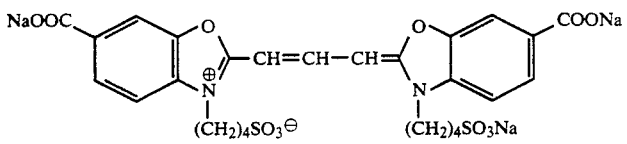

-continued
52.
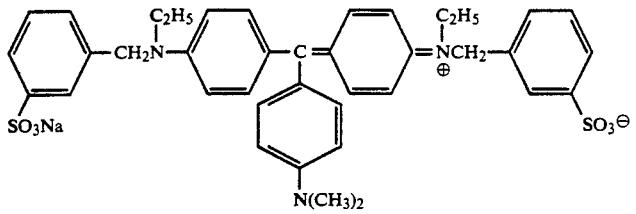
53.
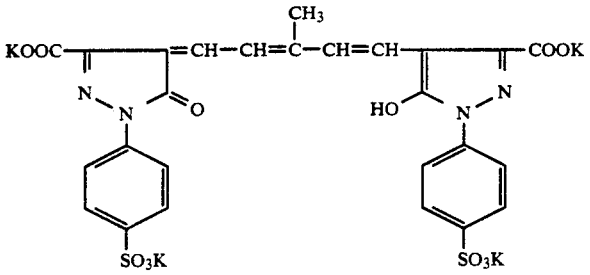
54.
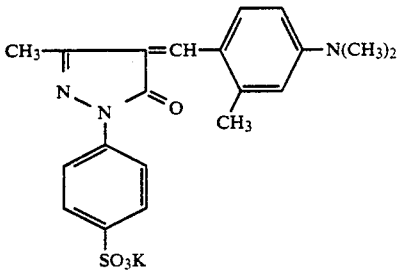
55.
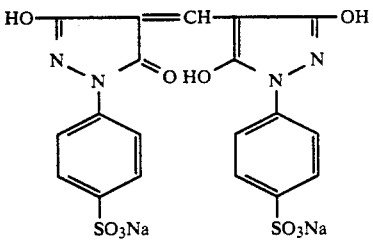
56.
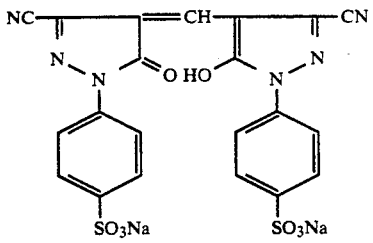
57.
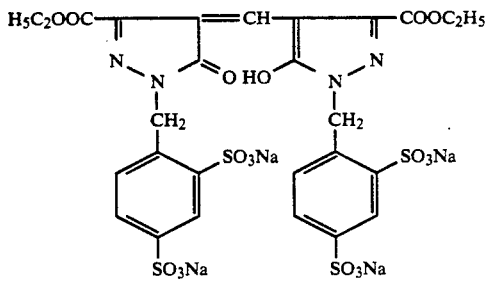

-continued
58.
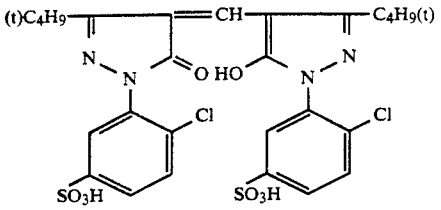
59.
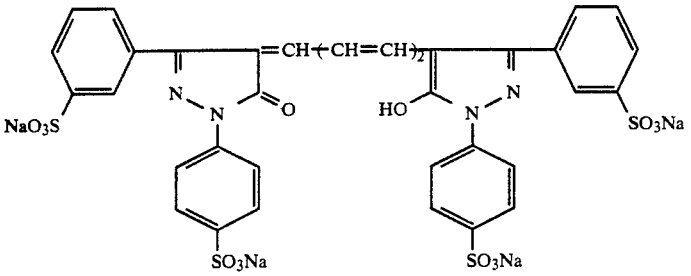
60.
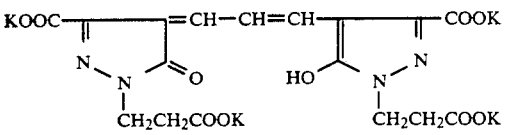
61.
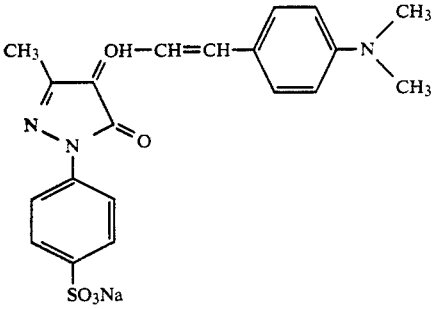
62.
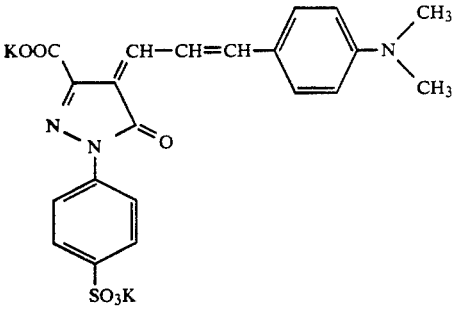
63.
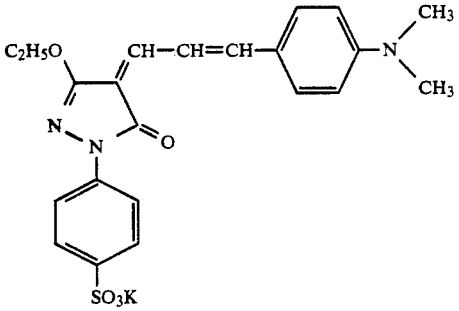
The photographic processing of the sensitive material of the present invention can be carried out according to any known methods, or any known method using processing solutions for black and white photographic processing, as described, e.g., in *Research Disclosure* RD No. 17643 (176), pp. 28–30. Processing temperatures are generally chosen in the range of from 18° to 50° C. Although temperatures lower than 18° C. and higher than 50° C. may be used, a rapid processing performed at a temperature of 30° to 45° C. using an automatic developing machine is particularly preferred as the photographic processing to be applied to the present invention.

A dry to Dry processing time (exclusive of exposure time) is chosen from the range of generally 30 to 120 sec., particularly 30 to 90 sec., in the case of radiographic direct X-ray sensitive materials for medical use, while it is chosen from the range of generally 5 min. or less, particularly from 3 to 5 min., in the case of industrial X-ray sensitive materials.

The developer to be used for the black and white photographic processing in the present invention can contain known developing agents. Specifically, dihydroxybenzenes (e.g., hydroquinone), 3-pyrazolidones (e.g., 1-phenyl-3-pyrazolidone), aminophenols (e.g., N-methyl-p-aminophenol) and the like can be used as developing agents individually or in combination. In addition to the above-described developing agents, the developer generally contains known additives including preservatives, alkali agents, pH buffers and antifoggants, and optionally dissolution aids, toning agents, development accelerators (e.g., quaternary salts, hydrazine, benzyl alcohol, etc.), surface active agents, defoaming agents, hard water softening agents, hardeners (e.g., glutaraldehyde), viscosity-imparting agents (tackifier) and so on, if desired.

In a special manner of development-processing which can be used, a sensitive material in which a developing agent may be incorporated, e.g., into its emulsion layer, is processed with an alkaline solution to achieve development. When developing agents to be used are hydrophobic, they may be incorporated into an emulsion layer using various methods as described in Research Disclosure, RD No. 16928, U.S. Pat. No. 2,739,890, British Patent 813,253, West German Patent 1,547,763, and so on. The development-processing described above may be carried out in combination with a silver salt stabilizing treatment with a thiocyanate.

As the fixing solution, any of composition having generally used can also be used in the present invention. Examples of fixing agents which can be used include not only thiosulfates and thiocyanates, but also organic sulfur compounds which have so far been known as effective fixing agents. The fixing solution may additionally contain water-soluble aluminium salts as a hardener. A suitable fixing time is generally 15 sec. or less, preferably 10 sec. or less, and particularly preferably 7 sec. or less.

The silver halide which can be used in the present invention may include any of silver chloride, silver chlorobromide, silver bromide, silver iodobromide and silver chloroiodobromide. From the viewpoint of high sensitivity, silver bromide and silver iodobromide are preferred. In particular, those having an iodide content of 0 to 3.5 mol % are preferred.

In the case of silver iodobromide, a particularly preferred grain structure is one which has a high iodide content phase inside the grains.

Further, such silver halides may be used together with compounds of the kind which can release inhibitors upon development, as described in Japanese Patent Application (OPI) Nos. 230135/86 and 25653/88.

A suitable coverage of silver in case of the radiographic sensitive material for medical use is generally 1.0 to 6.8 g/m$^2$ and particularly 1.5 to 4 g/m2, on one side of the support, while that in the industrial X-ray sensitive material is generally 6 to 15 g/m$^2$ and particularly 9 to 11 g/m$^2$, on one side of the support.

The average size of the emulsion grains, which refers to an average diameter of spheres having the same volume as the grains, is preferably 0.3 micron (μm) or more and particularly from 0.3 to 2.0 microns. The grain size distribution may be either narrow or broad.

The silver halide grains in the emulsions may have a regular crystal form such as a cube, an octahedron or the like; and irregular crystal form, such as a spherical form, a tabular form, a pebble-like form etc.; or a composite form of two or more thereof. Also, a mixture of grains having various crystal forms may be present in the emulsions.

In particular, tabular grains can be effectively used as silver halide grains to be applied to the present invention.

Preparation of the tabular grains can be effected using a proper combination of two or more of methods well-known in the art.

Tabular grain silver halide emulsions are described in Cugnac & Chateau, *Evolution of The Morphology of Silver Bromide Crystals during Physical Ripening,* Science et Industrie Photographie, vol. 33, No. 2, pages 121–125 (1962), Duffin, *Photographic Emulsion Chemistry,* pages 66–72, Focal Press, New York (1966), A. P. H. Trivelli & W. F. Smith, Photographic Journal, vol. 80, page 285 (1940), and so on, and can be prepared with ease by reference to methods as described in Japanese Patent Application (OPI) Nos. 127921/83, 113927/83 and 113928/83, and U.S. Pat. No. 4,439,520, and so on. As the tabular grains preferably used in the present invention, it is to be preferred that they should have an average aspect ratio of 3 or more, particularly 4 to 8, expressed according to the definition given in the 12th column of U.S. Pat. No. 4,439,520.

In addition, tabular grains can be obtained as follows: Seed crystals in which tabular grains are present in an amount of 40% or more by weight are firstly formed in the presence of a relatively low pBr, or a pBr of 1.3 or less, and then silver and halogen solutions are simultaneously added keeping the pBr to the same extent to grow the seed crystals.

In the course of the grain growth, it is desired that the addition of silver and halogen solutions should be performed so that nucleation may not newly occur.

Sizes of tabular silver halide grains can be adjusted by temperature control, proper selection of the kind and the quantity of solvent, control of addition speeds of a silver salt and halides to be used at the time of grain growth, and so on.

Among silver halide grains having a tabular form, monodisperse hexagonal tabular grains are especially useful.

A brief description of the structure and the preparation method of the monodisperse hexagonal tabular grains to be used in the present invention is given below, even though details thereof are described in Japanese Patent Application No. 299155/86.

Said emulsion is a silver halide emulsion made with a dispersion medium and silver halide grains. Not less than 70% of said silver halide grains based on the whole projection areas thereof are tabular grains having two parallel outer surfaces which are hexagonal in shape. As for the hexagonal surface, the ratio of the length of the longest side to that of the shortest side is 2 or less. Further, the hexagonal tabular silver halide grains have such a monodisperse size distribution that the variation coefficient (which refers to the value obtained by dividing the standard deviation of grain sizes expressed in terms of projection area diameter of the grains by the average grain size) is 20% or less. Furthermore, said grains have an aspect ratio of 2.5 or more, and a grain size of 0.2 micron (μm) or larger.

The composition of said hexagonal tabular grains may be any of the compositions including silver bromide, silver iodobromide, silver chlorobromide and silver chloroiodobromide. When iodide ion is contained therein, the content thereof ranges from 0 to 30 mol %. The crystal structure of said grains may be uniform throughout, or the grains may have a layer structure such that the interior and the surface thereof may differ in halide composition. In addition, it is preferred that reduction sensitization silver nuclei should be contained inside the grains.

Said silver halide grains can be prepared via nucleation, Ostwald ripening and grain growth, and details of these steps are described in Japanese Patent Application No. 299155/86.

The silver halide grains to be used in the present invention may also be core/shell type emulsion grains having a thickness of the shell capable of dissolving during development (i.e., usually having a thickness of 100 lattices or less) which contain the above hexagonal tabular grains as the core and form latent images in the shallow interior thereof. For the chemical sensitization methods applicable to the above-described core, methods for covering the core with a shell, and the development-processing with a developer containing a silver halide solvent, Japanese Patent Application (OPI) No. 133542/84 and British Patent No. 145,876 can be referred to. Therein, a thickness of the shell is 1 to 100 lattices, preferably 5 to 50 lattices.

Further, the silver halide grains to be used in the present invention may be those formed by using hexagonal tabular grains as host grains and allowing guest grains having various halide compositions to undergo epitaxial growth. For the details of the epitaxial growth of guest grains, Japanese Patent Application (OPI) Nos. 108526/83, 133540/82 and 32443/87 can be referred to.

The hexagonal tabular grains which can be used in the present invention may have dislocation lines in the inner part thereof. In order to examine whether dislocation lines are present or not, and how many dislocation lines are present, observations with a low temperature (liquid He temperature) transmission electron microscope should be performed.

The hexagonal tabular grains having dislocation lines can be formed by adding an iodide for a certain period at the stage of crystal growth of the hexagonal tabular grains, or grains containing hexagonal tabular grains as seed crystals. In this case, a certain period is intended to include from a moment (a period of about ½ second) to the whole period of crystal growth. The dislocation lines are formed when an iodide is added at such a speed that the difference between the iodide content in the iodobromide deposited by the addition and that in the iodobromid of the substrate may become 5 mol % or more.

In the present invention, the light-sensitive silver halide emulsion to be used may be a mixture of two or more of different silver halide emulsions. Emulsions to be mixed may differ in grain size, halide composition, sensitivity and so on. For instance, spherical form or pebble-like form silver halide light-sensitive emulsions and a light-sensitive emulsion comprising tabular grains having an aspect ratio of 3 or more may be used in the same layer, or in different layers as described in Japanese Patent Application (OPI) No. 127921/83. When used in different layers, the light-sensitive silver halide emulsion comprising tabular grains may be located nearer to or more distant from the support.

The crystal structure of the silver halide grains may be uniform throughout, or the grains may have such a layer structure that the interior and the surface thereof may differ in quality, or the grains may be those of a so-called conversion type as described, e.g., in British Patent No. 635,841 and U.S. Pat. No. 3,622,318. Further, silver halides differing in composition may be fused together by epitaxial junction. Furthermore, silver halides may be fused together with compounds other than silver thiocyanate and silver oxide. As for the latent image distribution, the silver halide grains may be those of the kind which form latent images predominantly at the surface of the grains (i.e., surface latent image) or those of the kind which mainly form latent images inside the grains (i.e., internal latent image). In particular, grains of the kind which form latent images in such a condition as to center around the particular point at the surface (e.g., apexes) are preferred.

At the stage of forming silver halide grains or allowing the formed grains to ripen physically in the course of preparing a silver halide emulsion, cadmium salts, zinc salts, lead salts, thallium salts, iridium salts or complex salts thereof, rhodium salts or complex salts thereof, iron salts or complex salts thereof, and/or so on may be present or coexist.

Further, a so-called silver halide solvent, such as ammonia, thioether compounds, thiazolidinethiones and quaternary thioureas, may be present at the stage of grain formation.

The silver halide emulsion to be used in the present invention can be chemically sensitized according to known methods, such as sulfur sensitization, reduction sensitization, gold sensitization and so on. These methods may be used independently or in combinations of two or more.

Representative of noble metal sensitization methods is a gold sensitization method in which gold compounds, mainly gold complex salts, are used. Of course, complex salts of noble metals other than gold, e.g., platinum, palladium, iridium, etc. may be present together. Concrete examples of such sensitization methods are described in U.S. Pat. No. 2,448,060, British Patent 618,061, and so on.

In sulfur sensitization methods, not only sulfur compounds contained in gelatin but also various kinds of sulfur compounds, e.g., thiosulfates, thioureas, thiazoles, rhodanines, etc., can be used.

In reduction sensitization methods, stannous salts, amines, formamidinesulfinic acids, silane compounds and so on can be used.

For the purposes of prevention of fog and stabilization of photographic properties in the course of production, storage or photographic processing of sensitive materials, a wide variety of compounds can be added to the photographic emulsions to be used in the present invention. Specific examples of such compounds include azoles (such as benzothiazolium salts, nitroimidazoles, nitrobenzimidazoles, chlorobenzimidazoles, bromobenzimidazoles, nitroindazoles, benzotriazoles, aminotriazoles, etc.); mercapto compounds such as mercaptotetrazoles, marcaptobenzothiazoles, mercaptobenzimidazoles, mercaptothiadiazoles, mercaptotetrazoles, (especially 1-phenyl-5-mercaptotetrazole), mercaptopyrimidines, mercaptotriazines, etc.); thioketo compounds such as oxazolinethione; azaindenes such as triazaindenes, tetraazaindenes (especially 4-hydroxy-substituted 1,3,3a,7-tetraazaindenes), pentaazaindenes, etc.; and a number of compounds known as antifoggants or stabilizers, such as benzenethiosulfonic acid, benzene sulfinic acid, benzenesulfonic acid amide, etc.

In particular, nitron and its derivatives described in Japanese Patent Application (OPI) Nos. 76743/85 and 87322/85, mercapto compounds described in Japanese Patent Application (OPI) No. 80839/85, heterocyclic compounds described in Japanese Patent Application (OPI) No. 164735/82, and silver complex salts of heterocyclic compounds (e.g., silver 1-phenyl-5-mercaptotetrazole) can be preferably used.

Even though the light-sensitive silver halide emulsions of the present invention do not need to be subjected to any spectral sensitization, they are preferably sensitized spectrally with sensitizing dyes to light of longer wavelengths, e.g., blue light, green light, red light or infrared light. Examples of sensitizing dyes which can be used include cyanine dyes, merocyanine dyes, complex cyane dyes, complex merocyanine dyes, holopolar cyanine dyes, styryl dyes, hemicyanine dyes, oxonol dyes, hemioxonol dyes and so on.

Sensitizing dyes as described in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,567,458, 3,625,698, 2,526,632,and 2,503,776, Japanese Patent Application (OPI) No. 76525/73, Belgian Patent No. 691,807, and so on are useful in the present invention.

Such sensitizing dyes can be present in any step to be included in the production process of photographic materials, or they can be introduced into photographic materials at any stage in the period from the conclusion of production until just before coating. The above-described step may be the step of forming silver halide grains, the physical ripening step, the chemical ripening step, or so on.

The photographic emulsion layers and other hydrophilic colloidal layers which constitute the sensitive material of the present invention may contain various surface active agents for a wide variety of purposes, for instance, as a coating aid, an antistatic agent, for improvement of sliding property, emulsification or dispersion, prevention of adhesion and improvements in photographic characteristics (e.g., acceleration of development and increase in contrast and sensitization).

Examples of suitable surface active agents include nonionic surface active agents such as saponin (steroid type), alkylene oxide derivatives (e.g., polyethylene glycol, polyethylene glycol/polypropylene glycol condensates, polyethylene glycol alkyl ethers or polyethylene glycol alkyl aryl ethers, polyethylene oxide adducts of silicone, etc.), alkyl esters of sugars, and so on; anionic surface active agents such as alkyl sulfonates alkylbenzene sulfonates, alkylnaphthalene sulfonate, alkyl sulfates, N-acyl N-alkyltaurines, sulfosuccinic acid esters, sulfoalkylpolyoxyethylene alkyl phenyl ethers, and so on; amphoteric surface active agents such as alkylbetaines, alkylfulfone betaines, and so on; and cationic surface active agents such as aliphatic or aromatic quaternary ammonium salts, pyridinium salts, imidazolium salts, and so on.

Of these surface active agents, saponin; anionic ones including sodium dodecyl benzenesulfonate, sodium di-2-ethylhexyl-α-sulfosuccinate, sodium p-octylphenoxyethoxyethoxyethanesulfonate, sodium dodecylsulfate, sodium triisopropylnaphthalenesulfonate, sodium N-methyl-oleyltaurine and the like; cationic ones including dodecyltrimethylmethylammonium chloride, N-oleyl-N', N',N'-trimethylammoniodiaminopropane bromide, dodecylpyridinium chloride and the like; betaines including N-dodecyl-N,N-dimethylcarboxybetaine, N-oleyl-N,N-dimethylsulfobutylbetaine and the like; and nonionic ones including poly(mean polymerization degree n=10)oxyethylene acetyl ether, poly(n=25)oxyethylene p-nonylphenol ether, bis(1-poly(n=15)oxyethyleneoxy-2,4-di-t-pentylphenyl)ethane and the like are particularly preferably used.

Specific examples of antistatic agents which can be preferably used include fluorine-containing surface active agents such as potassium perfluorooctanesulfonate, sodium N-propyl-N-perfluorooctanesulfonylglycine, sodium N-propyl-N-perfluorooctanesulfonylaminoethyloxypoly(n=3)oxyethylenebutanesulfonate, N-perfluorooctanesulfonyl-N',N',N'-trimethylammoniodiaminopropane chloride, N-perfluorodecanoylaminopropyl-N',N'-dimethyl-N'-carboxybetaine, etc.; nonionic surface active agents described, e.g., in Japanese Patent Application (OPI) Nos. 80848/85, 112144/86, 172343/87 and 173456/87 and so on; nitrates of alkali metals; and conductive tin oxide, zinc oxide, vanadium pentaoxide and compound oxides obtained by doping these oxides with antimony and so on.

Specific examples of matting agents which can be used in the present invention include fine particles of organic compounds, such as homopolymers of methylmethacrylate, copolymers of methylmethacrylate and methacrylic acid, starch, etc., and fine particles of inorganic compounds, such as silica, titanium oxide, strontium barium sulfate, etc., as described in U.S. Pat. Nos. 2,992,101, 2,701,245, 4,142,894 and 4,396,706.

A particle size is preferably 1.0 to 10 microns and particularly preferably 2 to 5 microns.

The surface layer of the sensitive material of the present invention can contain, as a lubricant, silicone compounds described in U.S. Pat. Nos. 3,489,578 and 4,047,958, and so on, colloidal silica described in Japanese Patent Publication No. 23139/81, paraffin wax, higher fatty acid esters, starch derivatives and so on.

Hydrophilic colloid layers of the sensitive material of the present invention can contain, as a plasticizer, polyols such as trimethylol propane, pentane diol, butane diol, ethylene glycol, clycerine, etc.

As the binders or the protective colloids which can be used in emulsion layers, interlayers and surface protecting layers of the sensitive material of the present invention, gelatin is advantageous. Also, other hydrophilic colloids can be employed.

Examples of hydrophilic colloids which can be employed, include proteins, such as gelatin derivatives, graft copolymers prepared from gelatin and other polymers, albumin, casein, etc.; sugar derivatives, such as cellulose derivatives, e.g., hydroxymethyl cellulose, carboxymethyl cellulose, cellulose sulfate, etc., sodium alginate, dextran, starch derivatives, etc.; and various kinds of synthetic hydrophilic high molecular weight substances including homopolymers and copolymers, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As the gelatin, not only lime-processed gelatin, but also acid-processed gelatin and enzyme-processed gelatin may be used. Further, hydrolysis products and enzymatic degradation products of gelatin can be employed.

Of these binders, combined use of gelatin and dextran or polyacrylamide having a molecular weight of 50,000 or less is preferred over others.

The photographic emulsions and light-sensitive hydrophilic colloids of the present invention may contain as inorganic or organic hardener.

Specific examples of usable hardeners in the present invention include chromium salts (such as chrome alum, chromium acetate, etc.), aldehyde series compounds (such as formaldehyde, glyoxal, glutaraldehyde, etc.), N-methylol compounds (such as dimethylol urea, methylol dimethylhydantoin, etc.), dioxane derivatives (such as 2,3-dihydroxydioxane, etc.), active vinyl compounds (such as 1,3,5-triacryloyl-hexahydro-s-triazine, bis(vinylsulfonyl) methyl ether, N,N'-methylenebis[β-(vinylsulfonyl)propionamide], etc.), reactive halogen-containing compounds (such as 2,4-dichloro-6-hydroxy-s-triazine, etc.), mucohalogenic acids (such as mucochloric acid, mucophenoxy chloricacid, etc.), isooxazoles, dialdehyde starch, 2-chloro-6-hydroxytriazinylated gelatin, and so on. These hardeners can be used alone or in combinations of two or more. In particular, active vinyl compounds described in Japanese Patent Application (OPI) Nos. 41221/78, 57257/78, 162546/84 and 80846/85, and active halides described in U.S. Pat. No. 3,325,287 are preferred over others.

It is preferred that the hydrophilic colloid layers in the sensitive material of the present invention should be hardened with a hardener so as to have a swelling degree of generally 200% or less, particularly 150% or less, in water.

In addition to light-sensitive silver halide emulsion layers, the sensitive materials of the present invention may have light-insensitive layers including a surface protective layer, an interlayer, an antihalation layer and so on.

Not less than two silver halide emulsion layers may be present in the sensitive material, if desired, and they may differ in sensitivity, gradation, and so on.

As the support, a polyethylene terephthalate film and a cellulose triacetate film are preferred. In particular, it is preferred that they should be colored with a blue tint.

In order to heighten adhesiveness between the support and a hydrophilic colloid layer, the support surface may be preferably subjected to corona discharge, glow discharge or irradiation with ultraviolet rays, or a subbing layer composed of styrene/butadiene copolymer latex, polyvinylidene chloride latex, or the like may be provided on the support surface. Further, a gelatin layer may be provided on the subbing layer.

Also, a subbing layer may be formed using an organic solvent containing a polyethylene swelling agent and gelatin. Adhesiveness to a hydrophilic colloid layer can be further increased by subjecting these subbing layers to a surface treatment.

The present invention will now be illustrated in more detail by reference to the following non-limiting examples.

Unless otherwise specified, all ratios, percents, etc. are by weight.

EXAMPLE 1

Production of Photographic Material 1 for Comparison

A pebble-like form silver iodobromide emulsion having an iodide content of 1.4 mol % and an average grain size of 0.6 micron (μm) was prepared using ammonia. This emulsion was chemically sensitized with 3 mg per mol of Ag of chloroauric acid and 10 mg per mol of Ag of sodium thiosulfate, and thereto was added 4-hydroxy-6-methyl-1,3,3a,7 tetraazaindene in an amount of 70 mg per mol of Ag as an antifoggant.

Separately, a gelatin solution containing gelatin, and additives including sodium polystyrenesulfonate, polymethylmethacrylate fine particles (mean particle size: 3.0 micron), polyethylene oxide and dextran having a mean molecular weight of 20,000, the total proportion of which was 30 wt % to gelatin, was prepared for forming a surface protective layer. Herein, acid-processed gelatin was used as the gelatin.

The above-described emulsion and gelatin solution were coated on both sides of a polyethylene terephthalate film using a simultaneous coating technique, and dried to produce photographic material 1. The silver coverage on each side was adjusted to 8.0 g/m$^2$.

Production of Photographic Material 2 according to Invention

In addition to the emulsion layer and the surface protective layer of photographic material 1, a gelatin layer containing the following polymer A was provided as the lowest layer using a three-layer simultaneous coating technique. Coverages of the ingredients which constituted the lowest layer are described below.

| (Lowest Layer) | |
|---|---|
| Gelatin | 0.5 g/m$^2$ |
| Polymer A | 0.0575 g/m$^2$ |

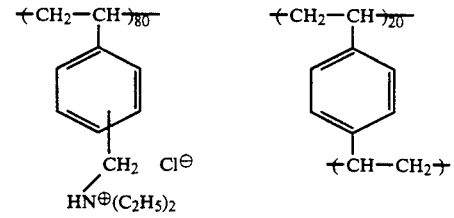

Production of Photographic Material 3 according to Invention

A photographic material was produced in the same manner as photographic material 2, except that the coverage of said polymer A was changed to 0.115 g/m$^2$.

Evaluation of Fixing Time

The time required for the completion of fixing using the following fixing solution was measured. Therein, the temperature of the fixing solution was kept at 25° C. The results are shown in Table 1.

| (Fixing Solution) | |
|---|---|
| Ammonium thiosulfate | 200 g |
| Sodum sulfite (anhydrous) | 20 g |
| Boric acid | 8 g |
| Disodium ethylenediaminetetraacetate | 0.1 g |

-continued

| | |
|---|---|
| Ammonium sulfate | 15 g |
| Sulfuric acid | 2 g |
| Glacial acetic acid | 22 g |
| Water to make | 5.0 l |
| (The pH was adjusted to 4.30.) | |

TABLE 1

| Photographic Material | Time for Completion of Fixing |
|---|---|
| 1 (Comparison) | 26 sec. |
| 2 (Invention) | 21 sec. |
| 3 (Invention) | 18 sec. |

As is apparent from the results of Table 1, the present invention enabled a remarkable reduction in fixing time.

EXAMPLE 2

30 g of gelatin, 5 g of potassium bromide and 0.05 g of potassium iodide were added to 1 liter of water placed in a vessel maintained at 75° C. Thereto, a water solution of silver nitrate (5 g based on silver nitrate) and a water solution of potassium bromide which contained 0.73 g of potassium iodide were added over a 1-minute period with stirring using a double jet method. Thereafter a water solution of silver nitrate (145 g based on silver nitrate) and a aqueous solution of potassium bromide (3.5 g based on KBr) were further added using the double jet method, wherein a rate of flow of each solution added was increased acceleratedly so that the flow rate at the conclusion of addition might become 8 times the flow rate at the beginning of addition. Thereafter, 0.37 g of a water solution of potassium iodide was further added.

After the completion of addition, soluble salts were removed at 35° C. using a sedimentation method. Then, the resulting emulsion was heated up to 40° C., and thereto was supplementally added 60 g of gelatin, followed by adjustment to the pH of 6.5. The temperature of the emulsion was again raised to 56° C., and then 650 mg of sodium salt of anhydro-5,5'-dichloro-9-ethyl-3,3'-di(3-sulfopropyl)oxacarbocyaninehydroxide was added as a sensitizing dye. Subsequently, the resulting emulsion was chemically sensitized with a combination of gold and sulfur sensitizers. The thus obtained emulsion grains were hexagonal tablets in shape, and had an average projected area diameter of 0.85 micron, and an average thickness of 0.158 micron.

To this emulsion were further added a mixture of 4-hydroxy-6-methyl-1,3,3a,7-tetraazaindene and 2,6-bis(hydroxyamino)-4-diethylamino-1,3,5-triazine as a stabilizer, and trimethylol propane as a drying antifoggant to prepare a coating composition.

Production of Photographic Material 4

For forming a surface protective layer, an aqueous gelatin solution containing, in addition to gelatin, polymethylmethacrylate fine particles, polyethylene oxide, sodium polyacrylic acid and dextran having a mean molecular weight of 39,000 was prepared.

The gelatin solution for a surface protective layer and the foregoing coating composition for an emulsion layer were coated on both sides of a blue-colored polyethylene terephthalate (abbreviated as PET) film in accordance with the simultaneous coating method, and dried to produce photographic material 4. Therein, the silver coverage on each side was controlled to 1.9 g/m$^2$. The PET base used therein had on each side 0.085 g/m$^2$ of gelatin as a subbing layer.

As the surface protective layer, the gelatin coverage was 0.8 g/m$^2$ on each side, and the dextran coverage was also 0.8 g/m$^2$ on each side.

1,2-Bis(vinylsulfonylacetamide)ethane was used as a hardener in a proportion of 4.5 wt % based on the sum total of gelatin coverages in the surface protective layers, the emulsion layers and the subbing layers.

Production of Photographic Materials 5 and 6

Photographic materials were produced in the same manner as photographic material 4, except that the same polymer as used in Example 1 and the dye illustrated below were added to gelatin in said subbing layer in the following amounts.

| Photographic Material | per Each Side of Subbing Layer: Coverage of Gelatin (g/m$^2$) | Coverage of Polymer A (g/m$^2$) | Coverage of Dye A (g/m$^2$) |
|---|---|---|---|
| 4 | 0.085 | — | — |
| 5 | 0.085 | 57.5 | — |
| 6 | 0.085 | 57.5 | 16.9 |

(Dye A)

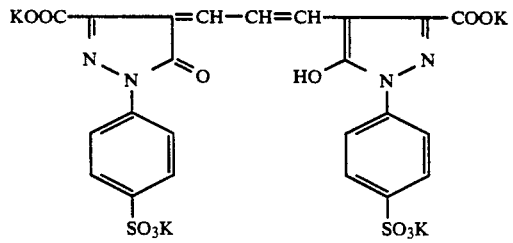

Evaluation of Fixing Time

The time required for the completion of fixing using the following fixing solution was measured. Therein, the temperature of the solution was kept at 25° C.

| (Fixing Solution) | |
|---|---|
| Ammonium thiosulfate | 140 g |
| Sodium sulfite (anhydrous) | 20 g |
| Disodium ethylenediaminetetraacetate | 0.1 g |
| Sulfuric acid | 2 g |
| Glacial acetic acid | 22 g |
| Water to make | 5.0 l |
| (the pH was adjusted to 4.95.) | |

The results obtained are shown in Table 2.

TABLE 2

| Photographic Material | Time for Completion of Fixing |
|---|---|
| 4 (Comparison) | 9.5 sec. |
| 5 (Invention) | 6.3 sec. |
| 6 (Invention) | 6.4 sec. |

As illustrated above, the effect of the present invention was unexpectedly superior.

EXAMPLE 3

In photographic processing with an automatic developing machine, the following processing solutions were used.

| | |
|---|---|
| Developer: | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 11.0 g |
| 5-Methylbenzotriazole | 2 g |
| Potassium bromide | 6 g |
| Water to make | 3 l |
| (The pH was adjusted to 10.15.) | |
| Fixing Solution: | |
| Ammonium thiosulfate | 560 g |
| Sodium sulfite | 60 g |
| Disodium ethylenediaminetetraacetate dihydrate | 0.10 g |
| Sodium hydroxide | 24 g |
| Water to make | 4 l |
| (The pH was adjusted to 5.10 using acetic acid.) | |

The photographic processing with the automatic developing machine was performed taking the following times for respective steps: It took 12 seconds for the development step carried out at 35° C., 9 seconds for the fixing step carried out at 25° C. and 8 seconds for the washing step carried out at 20° C., and the total processing time from Dry to Dry was controlled to 45 seconds.

After photographic materials 4 and 5 produced in Example 2 were subjected to the above photographic processing, measurements of the densities in non-exposed areas (exclusive of the base density) were performed with green light. The results are shown in Table 3.

TABLE 3

| Photographic Material | Green Light Density in Non-exposed Area |
|---|---|
| 4 (Comparison) | 0.05 |
| 5 (Invention) | 0.02 |

The difference in green light density is due to color contamination with the sensitizing dye used, and as is apparent from the results of Table 3, the invention has proved to make a remarkable improvement in color contamination.

EXAMPLE 4

28 g of gelatin, 30 g of potassium bromide and 4.5 g of potassium iodide were added to 850 ml of water placed in a vessel maintained at 38° C. Thereto, an ammoniacal silver nitrate solution (45 g based on silver nitrate) and an aqueous solution of potassium bromide were simultaneously added over a 10-minute period with stirring using a double jet method. After the completion of addition, the reaction system was adjusted to pH 5 with acetic acid, and then an aqueous solution containing 105 g of silver nitrate and an aqueous solution of potassium bromide were further added thereto at the same time over a 40-minute period using a double jet method. After the completion of the addition, soluble salts were removed at 35° C. using a sedimentation method. Then, the resulting emulsion was heated to 40° C., and thereto was supplementally added 75 g of gelatin, followed by adjustment of the pH to 6.4. The thus obtained emulsion grains were thick tabular form grains, and had an average projected area diameter of 0.63 micron (corresponding to the average diameter of the circles having the same areas as the projected areas of the grains), an average thickness of 0.30 micron, and an iodide content of 3.07 mol %. This emulsion was chemically sensitized by the combined use of sulfur and gold sensitizers. The resulting emulsion was called emulsion y.

To this emulsion were further added a mixture of 4-hydroxy-6-methyl-1,3,3a,7-tetraazaindene and 2,6-bis(hydroxyamino)-4-diethylamino-1,3,5-triazine as a stabilizer, and trimethylol propane as a drying antifoggant to prepare a coating composition for an emulsion layer.

Production of Photographic Materials 7 and 8

Photographic material 7 was produced in the same manner as photographic material 4, except that the foregoing emulsion was coated at a silver coverage of 3.2 g/m$^2$ in place of said tabular silver halide emulsion and the emulsion was coated on only one side of the support.

Similarly, photographic material 8 was produced in the same manner as photographic material 5, except that the foregoing emulsion was coated at a silver coverage of 0 3.2 g/m$^2$ in place of said tabular silver halide emulsion and that the emulsion was coated on only one side of the support.

Photographic materials 7 and 8 were processed with the automatic developing machine used in Example 3. The results obtained indicated that while fixing of photographic material 7 was incomplete, photographic material 8 was fixed completely. That is, the fix accelerating effect of the invention has proved to be remarkable.

While the invention has been described in detail and with reference to specific embodiments thereof, it will be apparent to one skilled in the art that various changes and modifications can be made therein without departing from the spirit and scope thereof.

What is claimed is:

1. A photographic element for medical use or nondestructive testing use comprising (1) a support having thereon at least one light-sensitive silver halide emulsion layer, and (2) a subbing layer located adjacent to and on the same side of the support as said at least one emulsion layer, said subbing layer containing a polymer capable of providing at least one cation site in a fixing solution, wherein said polymer capable of providing the at least one cation site in the fixing solution is a polymer represented by the formula (I):

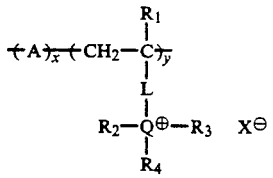

(I)

wherein A represents an ethylenically unsaturated monomer unit, $R_1$ represents a hydrogen atom or a lower alkyl group having 1 to about 6 carbon atoms, L represents a divalent group having 1 to about 12 carbon atoms, $R_2$, $R_3$ and $R_4$ which may be the same or different, each represents an alkyl group having 1 to about 20 carbon atoms, an aralkyl group having 7 to about 20 carbon atoms, or a hydrogen atom, provided that $R_2$, $R_3$ and $R_4$ may combine with one another to form a cyclic structure together with Q, Q represents N or P, $X^{\ominus}$ represents an anion, provided that $X^{\ominus}$ is not an iodine ion, x is 0 to about 90 mol %, and y is about 10 to about 100 mol % and wherein the amount of said polymer capable of providing at least one cation site in a fixing solution is 0.3 to 100 expressed in terms of the number of cation sites per 1 mol of the total amount of iodine in the element, provided that said polymer is present only in said subbing layer and provided that a total iodide content of silver halide is not 0 mol %.

2. The photographic element for medical use or nondestructive testing use as claimed in claim 1, wherein said polymer capable of providing a cation site in fixing solution is incorporated into a light-sensitive layer or a light-sensitive layer together with an anionic dye.

3. The photographic element for medical use or nondestructive testing use as claimed in claim 1, wherein said light-sensitive silver halide emulsion is tabular silver halide emulsion grains having an average aspect ration of 3 or more.

4. The photographic element for medical use or nondestructive testing use as claimed in claim 1, wherein said polymer capable of providing the at least one cation site in the fixing solution is a polymer latex represented by formula (II):

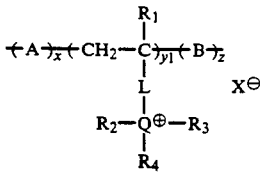

(II)

wherein A, $R_1$, $R_2$, $R_3$, $R_4$, L, Q, $X^{\ominus}$ and x are as defined in claim 1 for the formula (I), respectively, $y_1$ represents from 10 to 99.9 mol %, z represents from 0.1 to 50 mol %, and B represents a constitutional repeating unit of a copolymer which is derived from a copolymerizable monomer containing at least 2 ethylenically unsaturated groups.

5. The photographic element for medical use or nondestructive testing use as claimed in claim 1, wherein said light-sensitive silver halide emulsion is spectrally sensitized.

6. The photographic element for medical use or nondestructive testing use as claimed in claim 3, wherein the tabular silver halide emulsion grains are monodisperse hexagonal tabular grains.

* * * * *